US009207626B2

(12) United States Patent
Hashimoto et al.

(10) Patent No.: US 9,207,626 B2
(45) Date of Patent: Dec. 8, 2015

(54) IMAGE FORMING APPARATUS

(71) Applicant: Brother Kogyo Kabushiki Kaisha, Nagoya (JP)

(72) Inventors: Junichi Hashimoto, Toyohashi (JP); Norio Uchida, Nagoya (JP); Takashi Arakawa, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/298,296

(22) Filed: Jun. 6, 2014

(65) Prior Publication Data

US 2014/0363190 A1 Dec. 11, 2014

(30) Foreign Application Priority Data

Jun. 7, 2013 (JP) ..... 2013-121127

(51) Int. Cl.
*G03G 21/20* (2006.01)
*G03G 21/16* (2006.01)
*G03G 21/18* (2006.01)

(52) U.S. Cl.
CPC ..... *G03G 21/1619* (2013.01); *G03G 21/1623* (2013.01); *G03G 21/1842* (2013.01); *G03G 21/1853* (2013.01); *G03G 2221/1684* (2013.01)

(58) Field of Classification Search
CPC ..... G03G 21/1623; G03G 2221/1684; G03G 21/1842; G03G 21/1619; G03G 21/1676; G03G 21/1853; G03G 21/1604; G03G 21/1633; G03G 21/1647; G03G 21/1661; G03G 2221/163; G03G 2221/1654; G03G 2221/1815
See application file for complete search history.

(56) References Cited

U.S. PATENT DOCUMENTS

| | | | | |
|---|---|---|---|---|
| 2003/0185584 | A1 | 10/2003 | Hirose et al. | |
| 2009/0092412 | A1* | 4/2009 | Kei | 399/110 |
| 2009/0297203 | A1 | 12/2009 | Shimizu | |
| 2010/0119254 | A1* | 5/2010 | Tateishi et al. | 399/111 |
| 2010/0129111 | A1 | 5/2010 | Tamura | |
| 2010/0232832 | A1* | 9/2010 | Matsuda | 399/119 |
| 2012/0107009 | A1* | 5/2012 | Yano | 399/92 |

FOREIGN PATENT DOCUMENTS

| | | | |
|---|---|---|---|
| JP | 05-323755 | A | 12/1993 |
| JP | 09-204090 | A | 8/1997 |
| JP | 2003-287993 | A | 10/2003 |
| JP | 2006-091327 | A | 4/2006 |
| JP | 2009-288597 | A | 12/2009 |
| JP | 2010-128053 | A | 6/2010 |
| JP | 2010-276964 | A | 12/2010 |
| JP | 2012-073455 | A | 4/2012 |

* cited by examiner

*Primary Examiner* — Roy Y Yi
(74) *Attorney, Agent, or Firm* — Burr & Brown, PLLC

(57) ABSTRACT

An image forming apparatus including a plurality of image forming units arranged in parallel with each other at intervals in a predetermined direction toward a first side from a second side of the image forming apparatus, each image forming unit including a photoconductive drum, and a charger configured to charge the photoconductive drum, a frame body configured to support the plurality of image forming units, and a regulating member disposed between a first-side image forming unit of the plurality of image forming units that is closest to the first side in the predetermined direction and a first-side end portion of the frame body in the predetermined direction, the regulating member configured to regulate an air current and urge the first-side image forming unit.

7 Claims, 11 Drawing Sheets

110

IMAGE FORMING APPARATUS

CROSS-REFERENCE TO RELATED APPLICATION

This application claims priority under 35 U.S.C. §119 from Japanese Patent Application No. 2013-121127 filed on Jun. 7, 2013. The entire subject matter of the application is incorporated herein by reference.

BACKGROUND

1. Technical Field

The following description relates to one or more techniques for an image forming apparatus configured to perform image formation in an electrophotographic method.

2. Related Art

An image forming apparatus is configured to, after charging a photoconductive drum by a charger, form an electrostatic latent image on the photoconductive drum, and carry a developer image on the photoconductive drum. Hence, in order to prevent deterioration of the photoconductive drum due to ozone generated by the charger, it is required to keep the ozone from staying around the photoconductive drum.

In view of the above problem, an image forming apparatus has been known that is configured to generate an air current and let ozone flow along with the air current, so as to prevent the ozone from staying around the photoconductive drum.

For instance, a color printer has been proposed, in which four process cartridges, each including a photoconductive drum and a charger, are arranged in a front-to-rear direction (an arrangement direction), and a regulating member for regulating an air current is disposed between any two adjacent process cartridges.

In the proposed color printer, since each regulating member regulates an air current between corresponding two adjacent process cartridges so as to prevent inflow of air containing ozone into an undesired space, it is possible to secure a smooth current of the air containing ozone.

SUMMARY

However, in the proposed color printer, since each regulating member is disposed between two corresponding adjacent process cartridges, the rearmost process cartridge does not have a regulating member provided therefor.

Thus, around the rearmost process cartridge, air containing ozone might enter an undesired space, and thereby a current of the air containing ozone might be inhibited.

Aspects of the present invention are advantageous to provide one or more improved techniques, for an image forming apparatus, which make it possible to secure a smooth air current around an image forming unit disposed at one end in an arrangement direction in which a plurality of image forming units are arranged.

According to aspects of the present invention, an image forming apparatus is provided, which includes a plurality of image forming units arranged in parallel with each other at intervals in a first direction toward a first side from a second side of the image forming apparatus, each image forming unit including a photoconductive drum, and a charger configured to charge the photoconductive drum, a frame body configured to support the plurality of image forming units, and a regulating member being a flexible member, the regulating member being disposed between a first-side image forming unit of the plurality of image forming units that is closest to the first side in the first direction and a first-side end portion of the frame body in the first direction, the regulating member having a first-side end portion and a second-side end portion in the first direction, the first-side end portion of the regulating member being fixed to a first one of the first-side image forming unit and the first-side end portion of the frame body, the second-side end portion of the regulating member being configured to contact a second one of the first-side image forming unit and the first-side end portion of the frame body, the regulating member being configured to urge the first-side image forming unit.

According to aspects of the present invention, further provided is an image forming apparatus including a plurality of process cartridges arranged in parallel with each other at intervals in a predetermined direction toward a first side from a second side of the image forming apparatus are defined, each process cartridge including a photoconductive drum, and a charger configured to charge the photoconductive drum, a frame body configured to support the plurality of process cartridges in an attachable and detachable manner, a regulating member being a flexible member, the regulating member being disposed between a first-side process cartridge of the plurality of process cartridges that is closest to the first side in the predetermined direction and a first-side end portion of the frame body in the predetermined direction, the regulating member having a first-side end portion and a second-side end portion in the predetermined direction, the first-side end portion of the regulating member being fixed to a first one of the first-side process cartridge and the first-side end portion of the frame body, the second-side end portion of the regulating member being configured to contact a second one of the first-side process cartridge and the first-side end portion of the frame body, the regulating member being configured to apply an urging force to the first-side process cartridge, and a pressing member configured to press the first-side process cartridge supported by the frame body and to regulate a relative movement of the first-side process cartridge with respect to the frame body against the urging force of the regulating member.

According to aspects of the present invention, further provided is an image forming apparatus including a plurality of image forming units arranged in parallel with each other at intervals in a predetermined direction toward a first side from a second side of the image forming apparatus, each image forming unit including a photoconductive drum, and a charger configured to charge the photoconductive drum, a frame body configured to support the plurality of image forming units, and a regulating member being a flexible member, the regulating member being disposed between a first-side image forming unit of the plurality of image forming units that is closest to the first side in the predetermined direction and a first-side end portion of the frame body in the predetermined direction, so as to define at least a part of an airflow path formed to regulate an air current, the regulating member having a first-side end portion and a second-side end portion in the predetermined direction, the first-side end portion of the regulating member being fixed to a first one of the first-side image forming unit and the first-side end portion of the frame body, the second-side end portion of the regulating member being configured to contact a second one of the first-side image forming unit and the first-side end portion of the frame body, the regulating member being configured to urge the first-side image forming unit.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, embodiments according to aspects of the present invention will be described with reference to the accompanying drawings.

1. Overall Configuration of Printer

Figure 1:
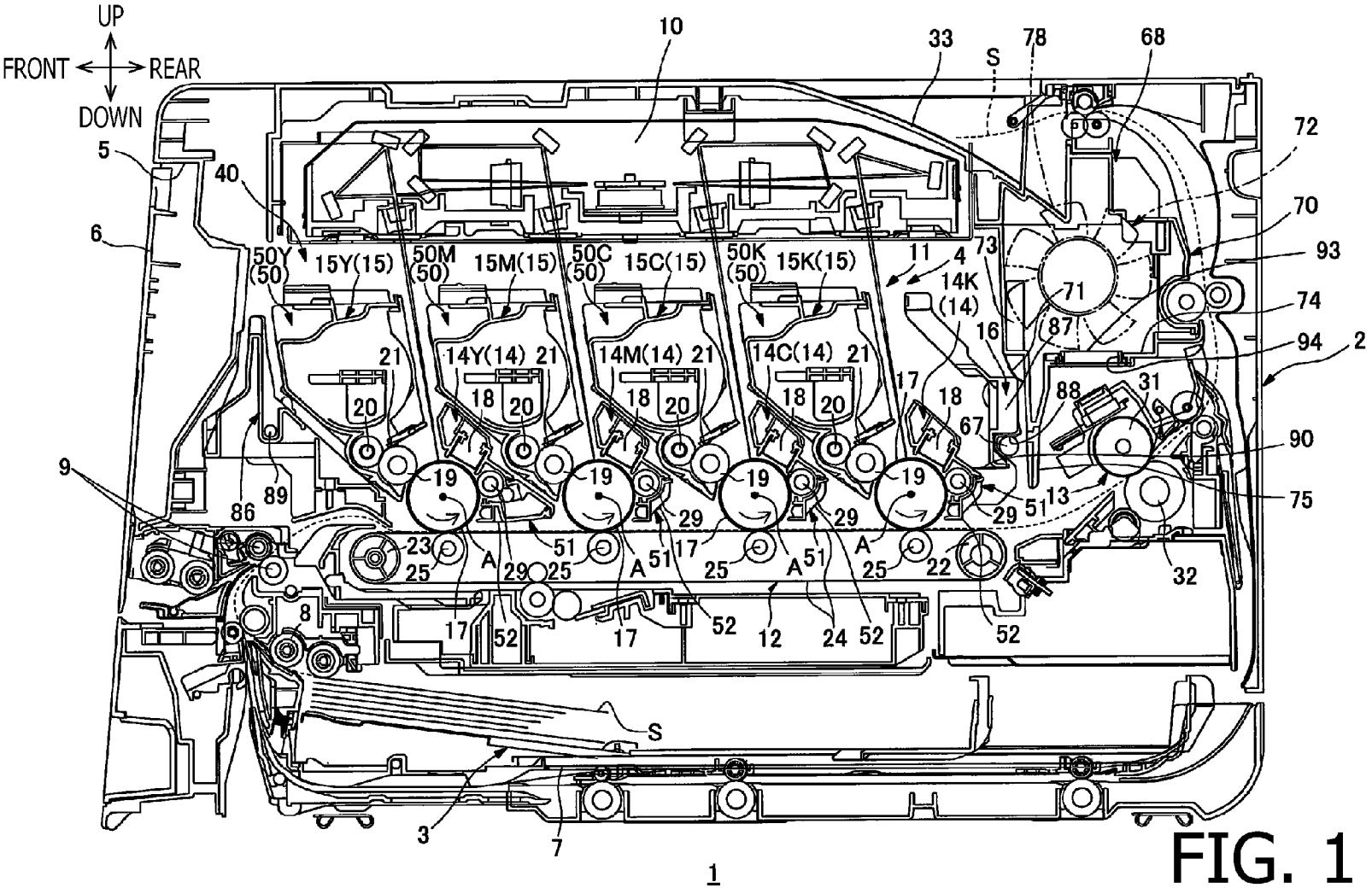
FIG. 1 is a cross-sectional side view showing a printer when a drawer frame is in a first position in a first embodiment according to one or more aspects of the present invention.

As shown in FIG. 1, a printer 1 of a first embodiment according to aspects of the present invention is a horizontal direct tandem type color printer.

The printer 1 includes, inside a main body casing 2, a sheet feeding section 3 configured to feed sheets S, and an image forming section 4 configured to form images on the sheets S fed from the sheet feeding section 3.

(1) Main Body Casing

The main body casing 2 is formed substantially in a rectangular box shape in a side view. The main body casing 2 is configured to accommodate the sheet feeding section 3 and the image forming section 4. Further, the main body casing 2 includes a wall portion with an opening 5, and a front cover 6 configured to open and close the opening 5.

It is noted that, in the following descriptions, a side on which the front cover 6 is disposed will be defined as a front side of the printer 1, and the opposite side will be defined as a rear side thereof. Further, a left side and a right side of the printer 1 will be defined in a front view of the printer 1. Specifically, on a sheet surface of FIG. 1, a left side will be defined as the front side of the printer 1, and a right side will be defined as the rear side thereof. Further, with respect to the sheet surface of FIG. 1, a near side (a front side) will be defined as the right side of the printer 1, and a far side (a back side) will be defined as the left side of the printer 1.

Further, in the first embodiment, a left-to-right direction is exemplified as an axial direction. The left side represents one side in the axial direction. The right side represents the other side in the axial direction. Further, a front-to-rear direction is exemplified as an arrangement direction (in which below-mentioned process units 50 are arranged). The rear side represents one side in the arrangement direction. The front side represents the other side in the arrangement direction. Further, an up-to-down direction is the vertical direction. The front-to-rear direction and the left-to-right direction are horizontal directions.

Figure 2:
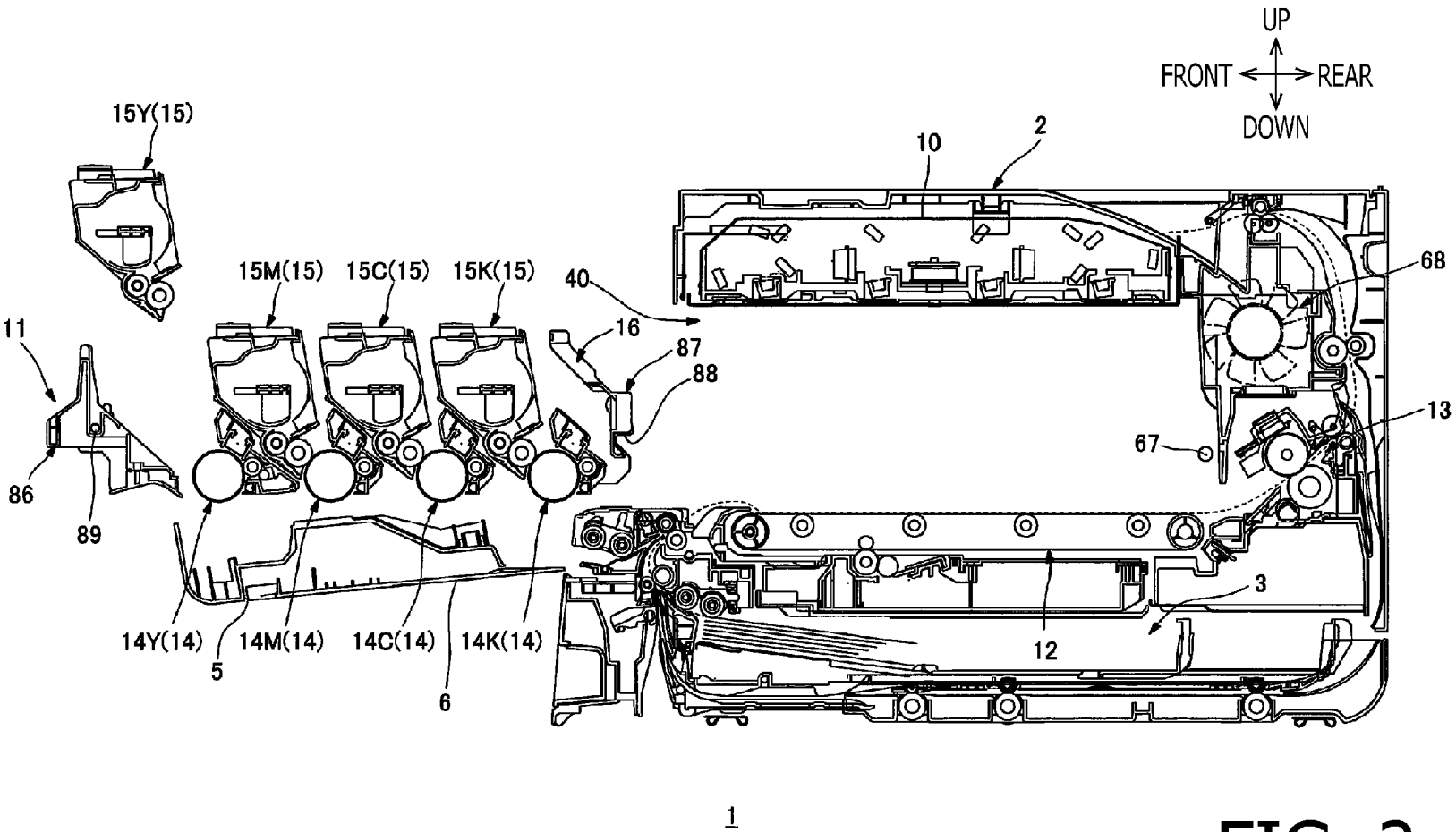
FIG. 2 is a cross-sectional side view showing the printer when the drawer frame is in a second position in the first embodiment according to one or more aspects of the present invention.

The front cover 6 is configured to swing around a lower end portion thereof, between a closed position to close the opening 5 and an open position to open the opening 5 as shown in FIG. 2.

(2) Sheet Feeding Section and Image Forming Section

As shown in FIG. 1, the sheet feeding section 3 includes a feed tray 7 configured to accommodate and support sheets S. The feed tray 7 is detachably attached to a bottom portion in the main body casing 2.

The image forming section 4 is disposed above the feed tray 7. The image forming section 4 includes a scanning unit 10, a drawer unit 11, a transfer unit 12, and a fuser unit 13.

The scanning unit 10 is disposed at an upper end portion in the main body casing 2. As indicated by solid lines in FIG. 1, the scanning unit 10 is configured to emit laser beams based on image data, toward the plurality of photoconductive drums 17, and expose the plurality of photoconductive drums 17.

The drawer unit 11 is disposed below the scanning unit 10, with a small gap from the scanning unit 10. The drawer unit 11 includes a drawer frame 16 and process units 50.

Figure 3:
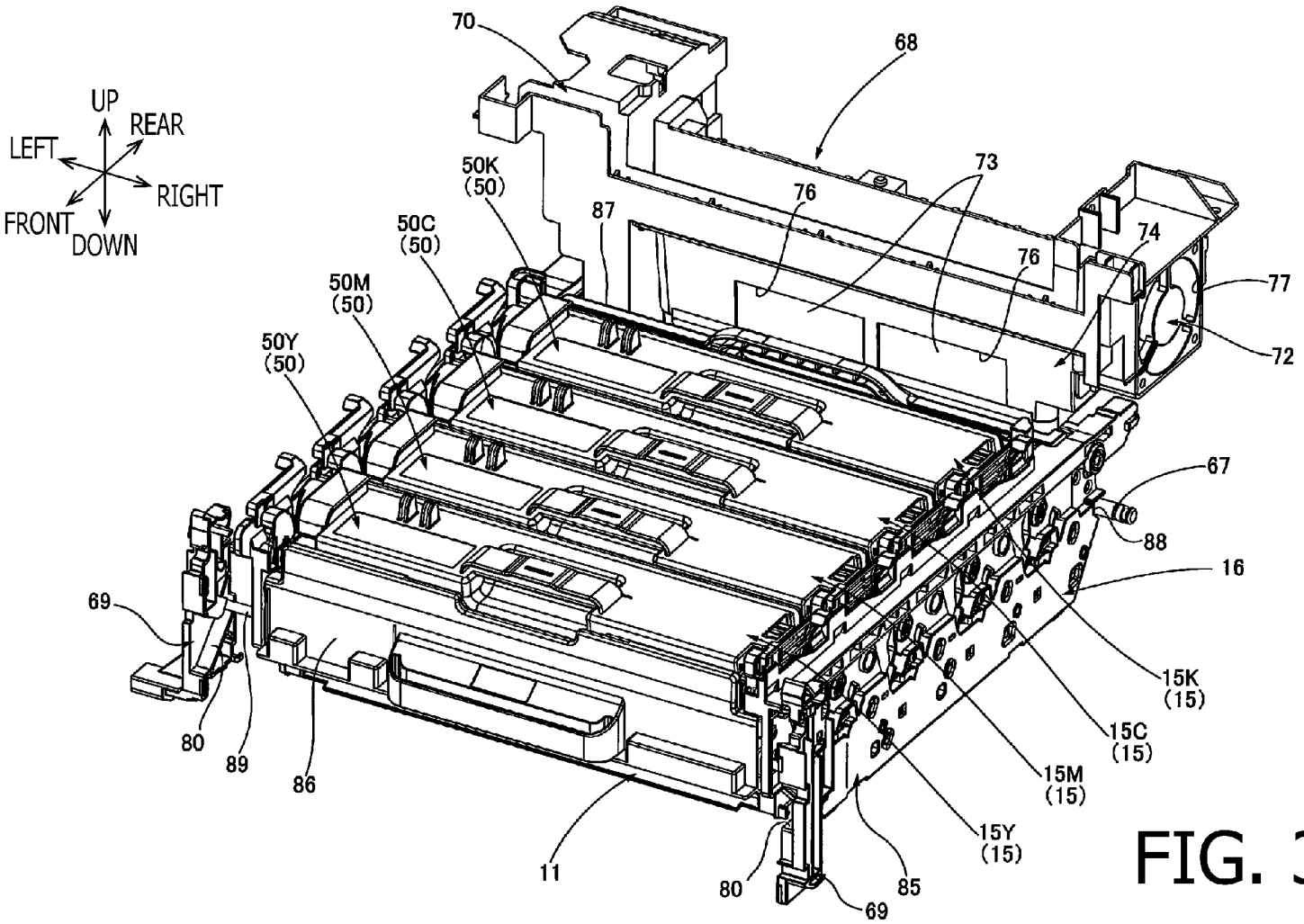
FIG. 3 is a perspective view showing the drawer frame and a duct portion as viewed from an upper right side in the first embodiment according to one or more aspects of the present invention.

As shown in FIG. 3, the drawer frame 16 is formed substantially in a rectangular frame shape in a plane view. Although details will be described later, as shown in FIGS. 1 and 2, the drawer frame 16 is configured to slide and move along the front-to-rear direction between a first position where the drawer frame 16 is accommodated in the main body casing 2 and a second position where the drawer frame 16 is pulled out from the main body casing 2 via the opening 5. It is noted that the following descriptions will be provided under an assumption that the drawer frame 16 is in the first position as shown in FIGS. 1, 3, 7, and 8.

As shown in FIG. 3, the drawer frame 16 supports the process units 50.

The process units 50 are four process units provided corresponding to four colors (i.e., yellow, magenta, cyan, and black), respectively.

In the drawer frame 16, the four process units 50 are arranged in parallel with each other at intervals of a small distance in the front-to-rear direction. More specifically, the four process units 50 are arranged serially in order of a yellow process unit 50Y, a magenta process unit 50M, a cyan process unit 50C, and a black process unit 50K from front to back.

As shown in FIG. 1, each process unit 50 includes a photoconductive drum 17, a scorotron charger 18, a drum cleaning roller 29, a development roller 19, a supply roller 20, and a layer thickness regulating blade 21.

The photoconductive drum 17 is formed substantially in a cylindrical shape extending in the left-to-right direction. The photoconductive drum 17 is disposed at a lower end portion of a corresponding process unit 50, such that a lower end portion of the photoconductive drum 17 is exposed out of the drawer frame 16. The photoconductive drum 17 is configured to rotate relative to the drawer frame 16.

The scorotron charger 18 is disposed apart from the photoconductive drum 17, at an upper rear side of the photoconductive drum 17.

The drum cleaning roller 29 is disposed behind the photoconductive drum 17. A front end portion of the drum cleaning roller 29 is in contact with the photoconductive drum 17.

The development roller 19 is disposed at an upper front side of the photoconductive drum 17. A lower front end portion of the development roller 19 is in contact with the photoconductive drum 17.

The supply roller 20 is disposed at an upper front side of the development roller 19. A lower rear end portion of the supply roller 20 is in contact with the development roller 19.

The layer thickness regulating blade 21 is formed substantially in a plate shape extending in the front-to-rear direction. The layer thickness regulating blade 21 is disposed above the development roller 19. A front end portion of the layer thickness regulating blade 21 is in contact with an upper end portion of the development roller 19.

Each process unit 50 is configured to store toner in a region higher than the development roller 19, the supply roller 20, and the layer thickness regulating blade 21.

The transfer unit 12 is configured to extend along the front-to-rear direction, above the feed tray 7 and under the plurality of photoconductive drums 17.

The transfer unit 12 includes a driving roller 22, a driven roller 23, a conveyance belt 24, and transfer rollers 25.

The driving roller 22 and the driven roller 23 are spaced apart from each other in the front-to-rear direction.

The conveyance belt 24 is wound around the driving roller 22 and the driven roller 23, such that an upper portion of the conveyance belt 24 contacts the plurality of photoconductive drums 17 from beneath. Further, the conveyance belt 24 is configured to move around in such a manner that the upper portion thereof in contact with the photoconductive drums 17 moves backward from the front, in response to rotations of the driving roller 22 and the driven roller 23.

There are four transfer rollers 25 disposed to face the four photoconductive drums 17 across the upper portion of the conveyance belt 24, respectively. In other words, each of the four transfer rollers 25 is disposed under the corresponding photoconductive drum 17 so as to pinch the upper portion of the conveyance belt 24 with the corresponding photoconductive drum 17.

The fuser unit 13 is disposed at an upper rear side of the transfer unit 12, behind the drawer unit 11. The fuser unit 13 includes a heating roller 31, and a pressing roller 32 in pressure contact with the heating roller 31.

(3) Image Forming Operation

Subsequently, an image forming operation by the printer 1 will be described. It is noted that the following image forming operation is performed under control of a controller (not shown).

(3-1) Development

Each supply roller 20 supplies the corresponding development roller 19 with toner in the corresponding process unit 50. The supply roller 20 and the development roller 19 positively charge the toner therebetween in a frictional manner.

Next, when the development roller 19 rotates, the layer thickness regulating blade 21 regulates a thickness of the toner supplied to the development roller 19. Thereby, the toner supplied to the development roller 19 is carried as a thin layer of a constant thickness, on a surface of the development roller 19.

Meanwhile, the scorotron charger 18 evenly charges a surface of the photoconductive drum 17. Thereafter, the scanning unit 10 exposes the surfaces of the charged photoconductive drums 17 based on predetermined image data. Thereby, an electrostatic latent image based on the image data is formed on the surface of each photoconductive drum 17.

When rotating, each development roller 19 supplies the toner carried thereon to the electrostatic latent image on the circumferential surface of the corresponding photoconductive drum 17. Thereby, a toner image is formed on the circumferential surface of the photoconductive drum 17.

(3-2) Sheet Feeding

A feed roller 8 is disposed at an upper front side of the feed tray 7. The feed roller 8, when rotating, feeds the sheets S placed on the feed tray 7 upward to between two registration rollers 9, on a sheet-by-sheet basis. Subsequently, the two registration rollers 9, when rotating, convey the sheet S toward the image forming section 4 at predetermined timing, so as to supply the sheet S between the conveyance belt 24 and the photoconductive drums 17.

Next, the conveyance belt 24 conveys the sheet S supplied between the conveyance belt 24 and the photoconductive drums 17, backward from the front. At this time, the photoconductive drums 17 and the transfer rollers 25 sequentially transfer the toner images of the different four colors onto the sheet S passing between the photoconductive drums 17 and the transfer rollers 25. Thereby, a color image is formed on the sheet S.

(3-3) Toner Fixing and Sheet Ejection

Next, when the conveyance belt 24 moves around, the sheet S with the color image formed thereon reaches between the heating roller 31 and the pressing roller 32. The heating roller 31 and the pressing roller 32 heat and press the sheet S which is passing therebetween. Thereby, the color image transferred on the sheet S is thermally fixed onto the sheet S.

After that, various rollers convey the sheet S so as to cause the sheet to U-turn toward an upper front side, and eject the sheet S onto a catch tray 33 formed on an upper surface of the main body casing 2.

2. Details of Main Body Casing

As shown in FIGS. 1 and 3, the main body casing 2 includes, in an internal space thereof, a duct portion 68 (exemplified as an inner wall), a main-body-side reference shaft 67, and pressing members 69.

As shown in FIG. 1, the duct portion 68 is disposed at a rear end portion in the main body casing 2, on a lower rear side of the scanning unit 10 and on an upper rear side of the transfer unit 12. Thereby, an accommodation portion 40, which is configured to accommodate the drawer unit 11, is formed and defined (demarcated) by the duct portion 68, the scanning unit 10, the transfer unit 12, and left and right side walls of the main body casing 2. In other words, the duct portion 68 is a rear end portion of the accommodation portion 40, and defines the rear end portion of the accommodation portion 40.

Figure 4A:
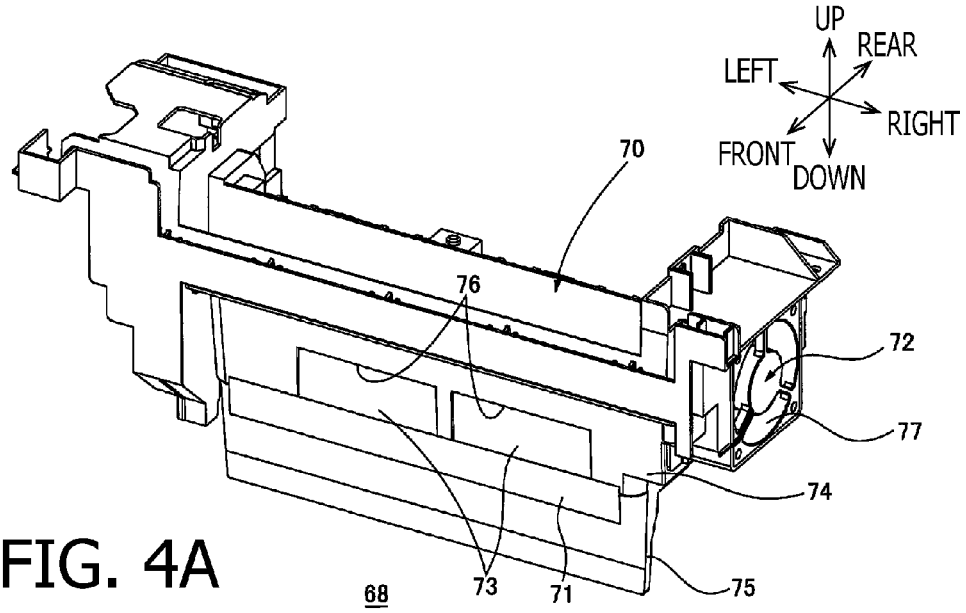
FIG. 4A is a perspective view showing the duct portion as viewed from the upper right side in the first embodiment according to one or more aspects of the present invention.

As shown in FIGS. 1 and 4A, the duct portion 68 includes a duct frame 70, a fan 72, ozone filters 73, a toner filter 93, and a duct-side regulating member 71.

The duct frame 70 includes a duct main body 74 and a lip portion 75.

The duct main body 74 is disposed above the fuser unit 13 and on an upper rear side of a below-mentioned rear beam 87. Namely, the duct main body 74 is disposed higher than the below-mentioned rear beam 87 and behind the drawer frame 16 (downstream relative to the drawer frame 16 in a direction from the other side to the one side in the arrangement direction).

As shown in FIG. 4A, the duct main body 74 is formed substantially in a box shape extending in the left-to-right direction. The duct main body 74 includes filter openings 76, a fan opening 77, and a fuser inlet port 94 (see FIG. 1).

There are two filter openings 76 arranged in the left-to-right direction in a front wall of the duct main body 74. Each filter opening 76 is formed substantially in a rectangular shape extending in the left-to-right direction in a front view. Each filter opening 76 penetrates the front wall of the duct main body 74 in the front-to-rear direction.

The fan opening 77 is disposed at a right wall of the duct main body 74. The fan opening 77 is formed substantially in a round shape in a side view. The right side wall of the main body casing 2 includes an outlet (not shown) at a portion facing the fan opening 77. Thereby, an internal space of the duct main body 74 communicates with an outside of the printer 1 via the fan opening 77 and the outlet (not shown).

As shown in FIG. 1, the fuser inlet port 94 is disposed at a lower wall 74 of the duct main body 74, and penetrates the lower wall 74 of the duct main body 74.

As shown in FIGS. 1 and 4A, the lip portion 75 is formed in a plate shape, which continuously extends downward from a front end portion of a bottom wall of the duct main body 74, and extends in the left-to-right direction. Further, the lip portion 75 is disposed in front of and apart from the fuser unit 13.

The fan 72 is disposed at a right end portion in the duct main body 74, on a left side of the right wall of the duct main body 74 (more specifically, on a left side of the fan opening 77).

The fan 72 includes rotary blades 78. The rotary blades 78 are configured to rotate relative to the duct main body 74, and let air in the duct main body 74 flow rightward from the left when rotating.

Each of the ozone filters 73 is an air-permeable filter configured to capture volatile organic compounds (VOD) contained in the air passing through the ozone filter 73, and decompose and remove ozone. The ozone filters 73 are two that correspond to the two filter openings 76, respectively.

Each ozone filter 73 is formed in a plate shape extending in the left-to-right direction. Each ozone filter 73 is disposed at a front end portion in the duct main body 74, so as to be located behind the filter opening 76 facing the ozone filter 73. Thereby, a front face of each ozone filter 73 is exposed out of the duct main body 74 via the corresponding filter opening 76.

The toner filter 93 is an air-permeable filter configured to capture contaminants (such as toner and paper powder) contained in the air passing through the toner filter 93. The toner filter 93 is provided corresponding to the fuser inlet port 94, and is fitted into the fuser inlet port 94.

The duct-side regulating member 71 is made of flexible material, more specifically, a resin film such as polyethylene terephthalate (PET). Therefore, the duct-side regulating member 71 is configured to be elastically deformed. Further, the duct-side regulating member 71 is formed substantially in a rectangular shape extending in the left-to-right direction in a front view, and extends in the vertical direction in a side view.

Figure 8:
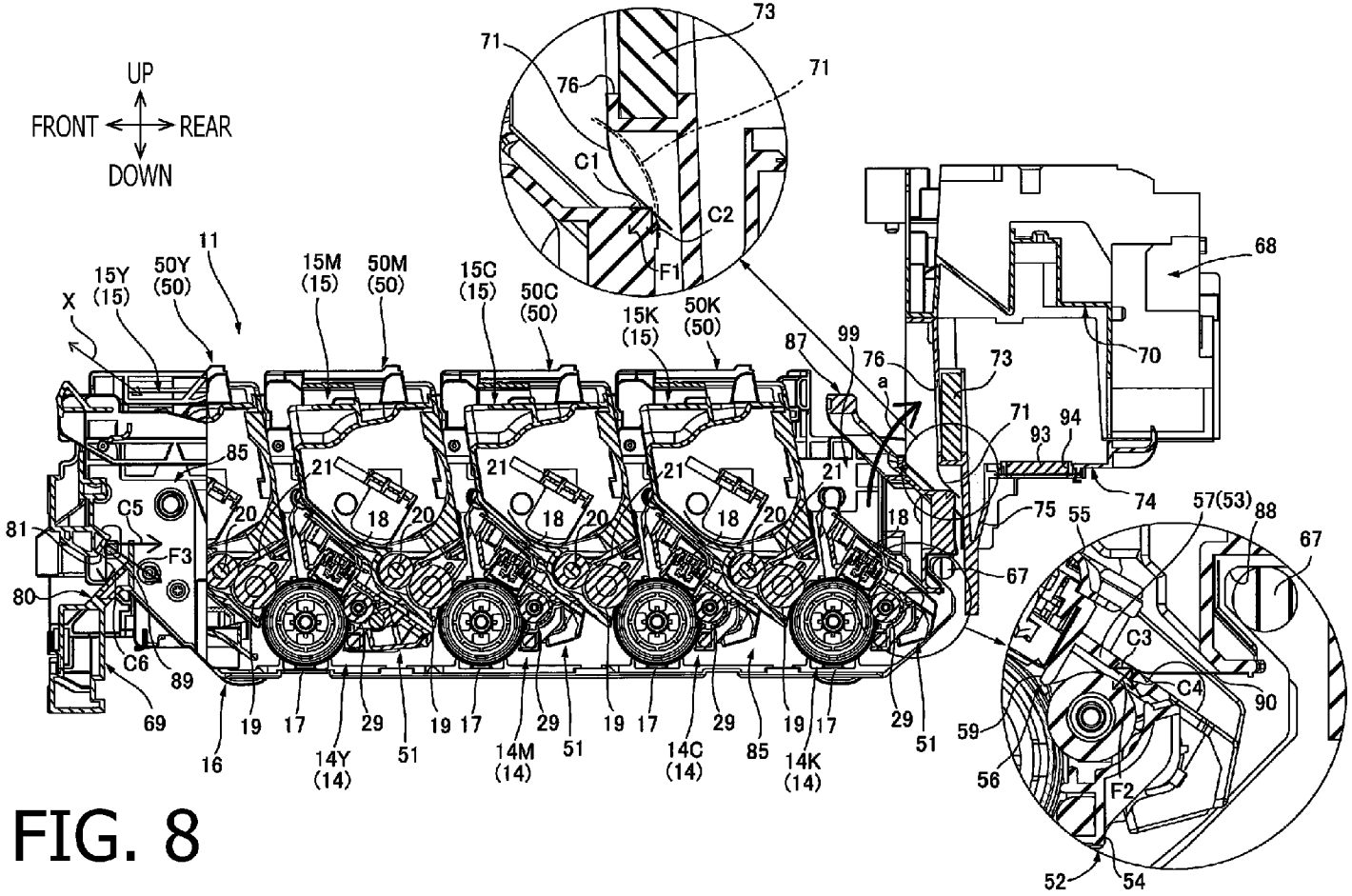
FIG. 8 shows a state where pressing members are pressing the drawer frame in order to illustrate the operations of setting the drawer frame into the main body casing and pulling out the drawer frame from the main body casing in the first embodiment according to one or more aspects of the present invention.

The duct-side regulating member 71 is supported by the duct portion 68, as an upper end portion of the duct-side regulating member 71 is fixed to a lower end portion of the front wall of the duct main body 74. Further, as shown in FIG. 8, when the drawer frame 16 is in the first position, a lower end portion of the duct-side regulating member 71 comes into contact with an upper end portion of a below-mentioned rear beam 87 from an upper rear side, and contacts the upper end portion of the rear beam 87 along the left-to-right direction. Namely, the duct-side regulating member 71 is disposed between the below-mentioned rear beam 87 and the duct main body 74.

Thereby, the duct-side regulating member 71 is elastically deformed and bent rearward from the front, in such a curved shape as to lean rearward.

Therefore, the duct-side regulating member 71 is configured to urge the drawer frame 16 toward a lower front side via the below-mentioned rear beam 87.

An urging force F1 of the duct-side regulating member 71 can be decomposed into an urging force component C1 to urge the drawer frame 16 forward and an urging force component C2 to urge the drawer frame 16 downward.

As shown in FIGS. 1 and 3, the main-body-side reference shaft 67 is disposed in front of and apart from the lip portion 75 of the duct portion 68. The main-body-side reference shaft 67 is formed substantially in a cylindrical shape extending in the left-to-right direction. Further, both a left end portion and a right end portion of the main-body-side reference shaft 67 are fixed to the main body casing 2.

As shown in FIG. 3, there are two pressing members 69 spaced apart from each other and provided corresponding to the left end portion and the right end portion of the main-body-side reference shaft 67, respectively. Each pressing member 69 is formed substantially in a rod shape extending in the vertical direction. Further, each pressing member 69 includes a shaft accepting groove 80 disposed at an inner side thereof in the left-to-right direction.

Each shaft accepting groove 80 is a concave portion recessed outward from the inside of the corresponding pressing member 69 in the left-to-right direction. As shown in FIG. 8, each shaft accepting groove 80 extends toward a lower rear side, from a front end portion to a rear end portion of the corresponding pressing member 69. Further, each shaft accepting groove 80 includes a pressing surface 81 disposed at a rear side of a front end face of the shaft accepting groove 80. Further, each pressing surface 81 extends along a direction connecting a lower front side and an upper rear side.

The two pressing members 69 are configured to move in conjunction with a swing motion of the front cover 6 by a known interlocking mechanism. Specifically, when the front cover 6 is in the open position, the two pressing members 69 are retracted toward an upper front side along a moving direction X connecting the upper front side and a lower rear side. Meanwhile, when the front cover 6 is in the closed position, the two pressing members 69 are moved toward the lower rear side along the moving direction X.

Further, when the front cover 6 is in the closed position, and each pressing member 69 is moved toward the lower rear side, the pressing surface 81 of each pressing member 69 presses a corresponding end portion of a drum-side reference shaft 89 in the left-to-right direction, toward a lower rear side.

3. Details of Process Units

As described above, the drawer unit 11 includes the drawer frame 16.

Figure 4B:
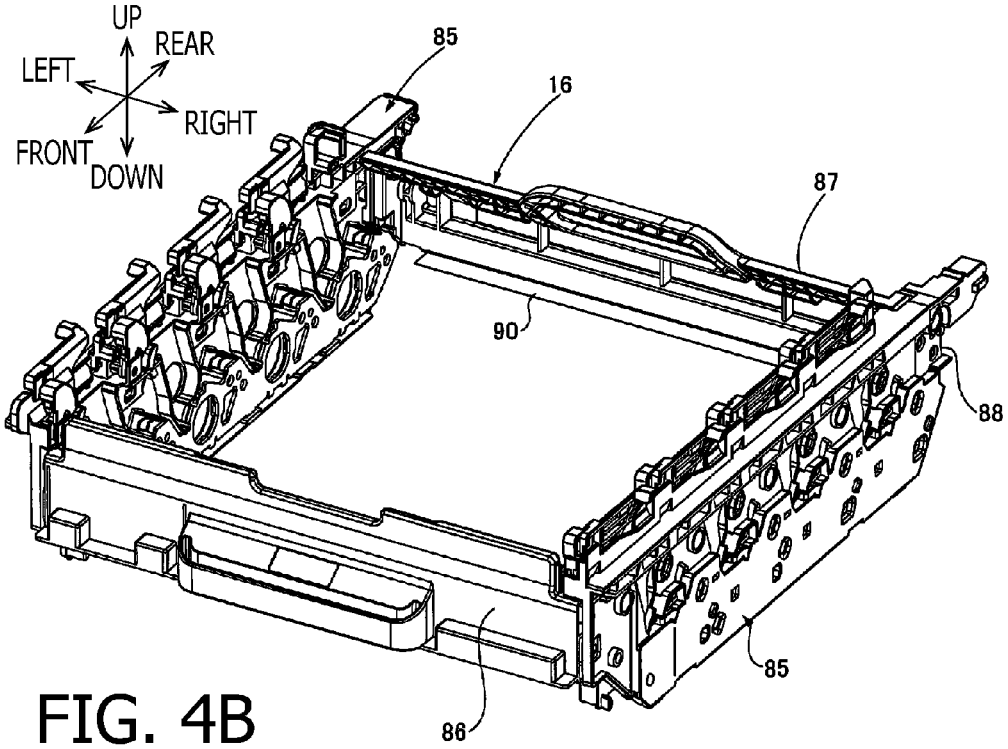
FIG. 4B is a perspective view showing the drawer frame as viewed from the upper right side in the first embodiment according to one or more aspects of the present invention.

As shown in FIG. 4B, the drawer frame 16 includes two side walls 85, a front beam 86, and a rear beam 87.

Figure 6:
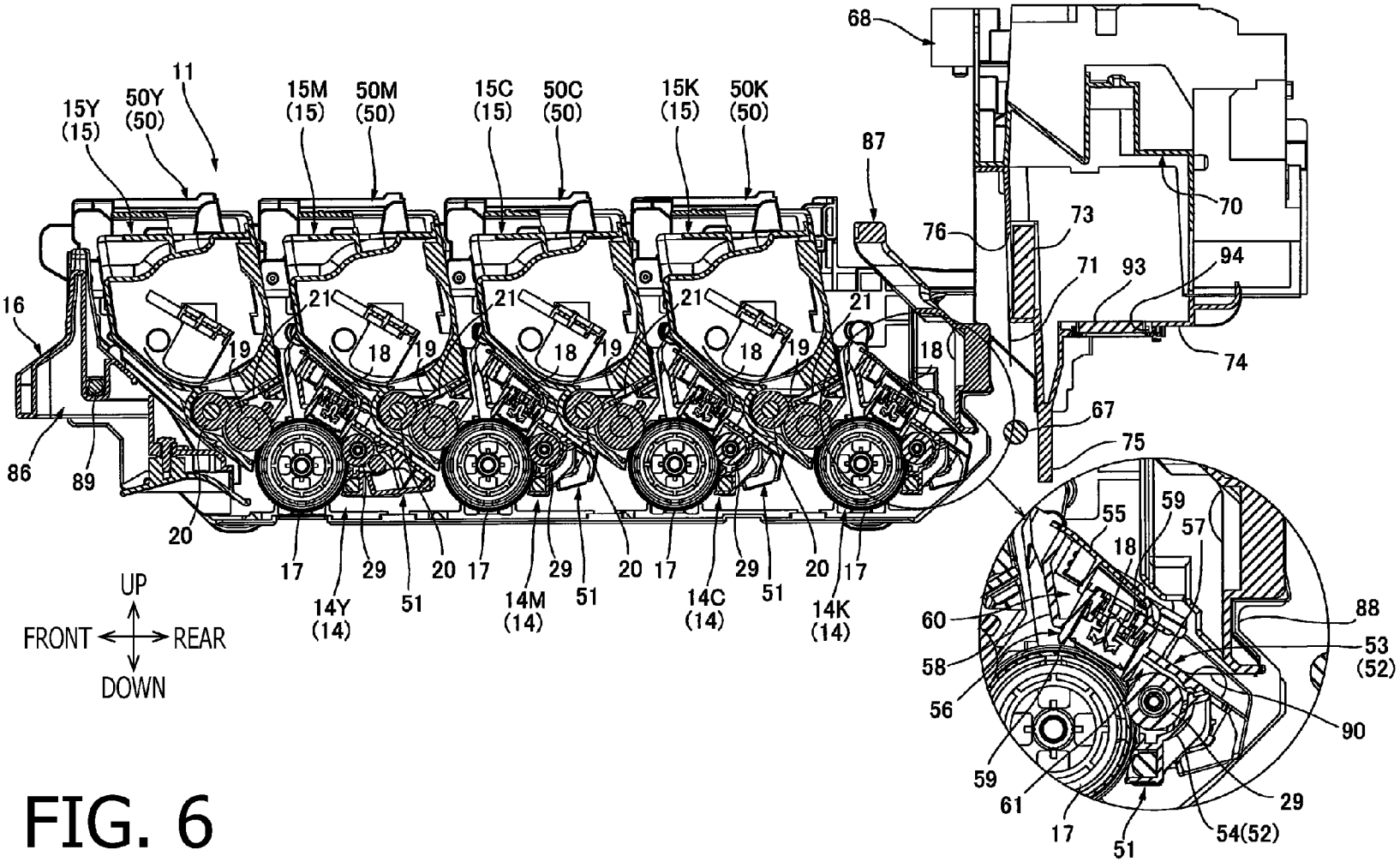
FIG. 6 shows a state where the drawer frame is the middle of moving between the first position and the second position in order to illustrate operations of setting the drawer frame into a main body casing and pulling out the drawer frame from the main body casing in the first embodiment according to one or more aspects of the present invention.
Figure 7:
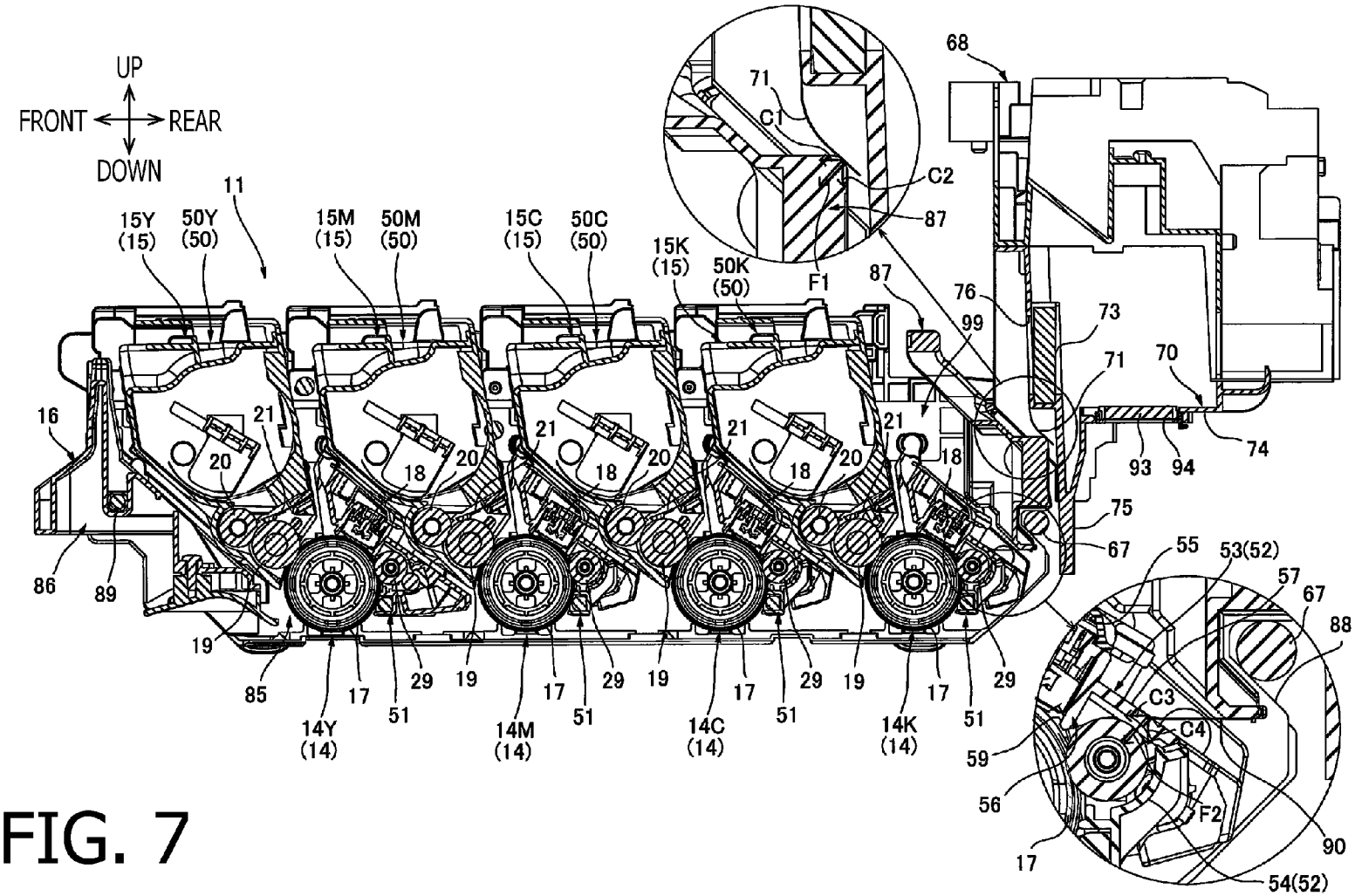
FIG. 7 shows a state where the drawer frame is in the first position in order to illustrate the operations of setting the drawer frame into the main body casing and pulling out the drawer frame from the main body casing in the first embodiment according to one or more aspects of the present invention.

The two side walls 85 are spaced apart from each other in the left-to-right direction. Each side wall 85 is formed substantially in a rectangular plate shape extending in the front-to-rear direction in a side view. Further, as shown in FIG. 6, each side wall 85 includes a notch portion 88 formed at a rear end portion thereof. The notch portion 88 is a substantially V-shaped groove in a side view. The notch portion 88 is cut forward from a substantially middle portion of a rear end of each side wall 85. As shown in FIG. 7, when the drawer frame 16 is in the first position, the notch portion 88 accepts the main-body-side reference shaft 67, and contacts the main-body-side reference shaft 67 from an upper side and a lower front side.

As shown in FIG. 4B, the front beam 86 is formed substantially in a rectangular plate shape extending in the left-to-right direction in a front view, so as to bridge a distance between front end portions of the two side walls 85.

Further, as shown in FIGS. 3 and 4B, the front beam 86 is configured to support the drum-side reference shaft 89. The drum-side reference shaft 89 is formed substantially in a cylindrical shape extending in the left-to-right direction, and passes through the front beam 86 and the front end portions of the two side walls 85 in the left-to-right direction. Each end portion of the drum-side reference shaft 89 in the left-to-right direction protrudes outward in the left-to-right direction from the front end portion of the corresponding side wall 85.

The rear beam 87 is formed substantially in a rectangular plate shape extending in the left-to-right direction in a rear view, so as to bridge a distance between rear end portions of the two side walls 85. Namely, the rear beam 87 is a rear end portion of the drawer frame 16, i.e., an end portion of the drawer frame 16 in the arrangement direction.

Further, the rear beam 87 is configured to support a drawer-side regulating member 90.

The drawer-side regulating member 90 is made of flexible material, more specifically, a resin film such as polyethylene terephthalate (PET). Therefore, the drawer-side regulating member 90 is configured to be elastically deformed. Further, the drawer-side regulating member 90 is formed substantially in a rectangular shape extending in the left-to-right direction in a plane view, and extends along the front-to-rear direction in a side view.

The drawer-side regulating member 90 is supported by the drawer frame 16, as a rear end portion of the drawer-side regulating member 90 is fixed to a lower end portion of the rear beam 87.

Further, as shown in FIG. 8, when the drawer frame 16 is in the first position, a front end portion of the drawer-side regulating member 90 contacts an upper face of a first extended wall 57 of a below-mentioned black drum unit 14K from an upper rear side and along the left-to-right direction. Namely, the drawer-side regulating member 90 is disposed between the below-mentioned black drum unit 14K and the rear beam 87.

Thereby, the front end portion of the drawer-side regulating member 90 is elastically deformed along the first extended wall 57, in such a curved shape as to lean upward. Therefore, the drawer-side regulating member 90 is configured to urge the first extended wall 57 of the below-mentioned black drum unit 14K toward a lower front side.

An urging force F2 of the drawer-side regulating member 90 can be decomposed into an urging force component C3 to urge the drawer frame 16 forward and an urging force component C4 to urge the drawer frame 16 downward.

Further, as described above, the drawer frame 16 is configured to support the plurality of process units 50.

Each process unit 50 includes a drum unit 14 and a development cartridge 15. In other words, in the same manner as the process units 50, there are four drum units 14 provided corresponding to the four colors, i.e., yellow, magenta, cyan, and black, respectively. Additionally, there are four development cartridges 15 provided corresponding to the four colors, i.e., yellow, magenta, cyan, and black, respectively.

More specifically, the four drum units 14 are arranged sequentially in order of a yellow drum unit 14Y, a magenta drum unit 14M, a cyan drum unit 14C, and a black drum unit 14K from front to back. Namely, the black drum unit 14K is the rearmost one of the plurality of drum units 14, and is disposed at an end portion in the arrangement direction of the plurality of drum units 14. Further, the black drum unit 14K is disposed the closest to the fuser unit 13, among the plurality of drum units 14.

Additionally, the development cartridges 15 are arranged in parallel with each other at intervals, sequentially in order of a yellow development cartridge 15Y, a magenta development cartridge 15M, a cyan development cartridge 15C, and a black development cartridge 15K from front to back.

The plurality of drum units 14 are arranged in parallel with each other at intervals in the front-to-rear direction, under the plurality of process units 50, respectively, between lower portions of the two side walls 85.

Each drum unit 14 includes the aforementioned photoconductive drum 17 and a drum subunit 51. Therefore, the photoconductive drums 17 are arranged in parallel with each other at intervals in the front-to-rear direction, in the accommodation portion 40 of the main body casing 2.

Each photoconductive drum 17 is supported by the drawer frame 16, as a left end portion and a right end portion of the photoconductive drum 17 are rotatably supported by the two side walls 85, respectively. Thereby, as shown in FIG. 1, each photoconductive drum 17 is configured to rotate around a central axis A extending in the left-to-right direction, relative to the drawer frame 16.

Figure 5:
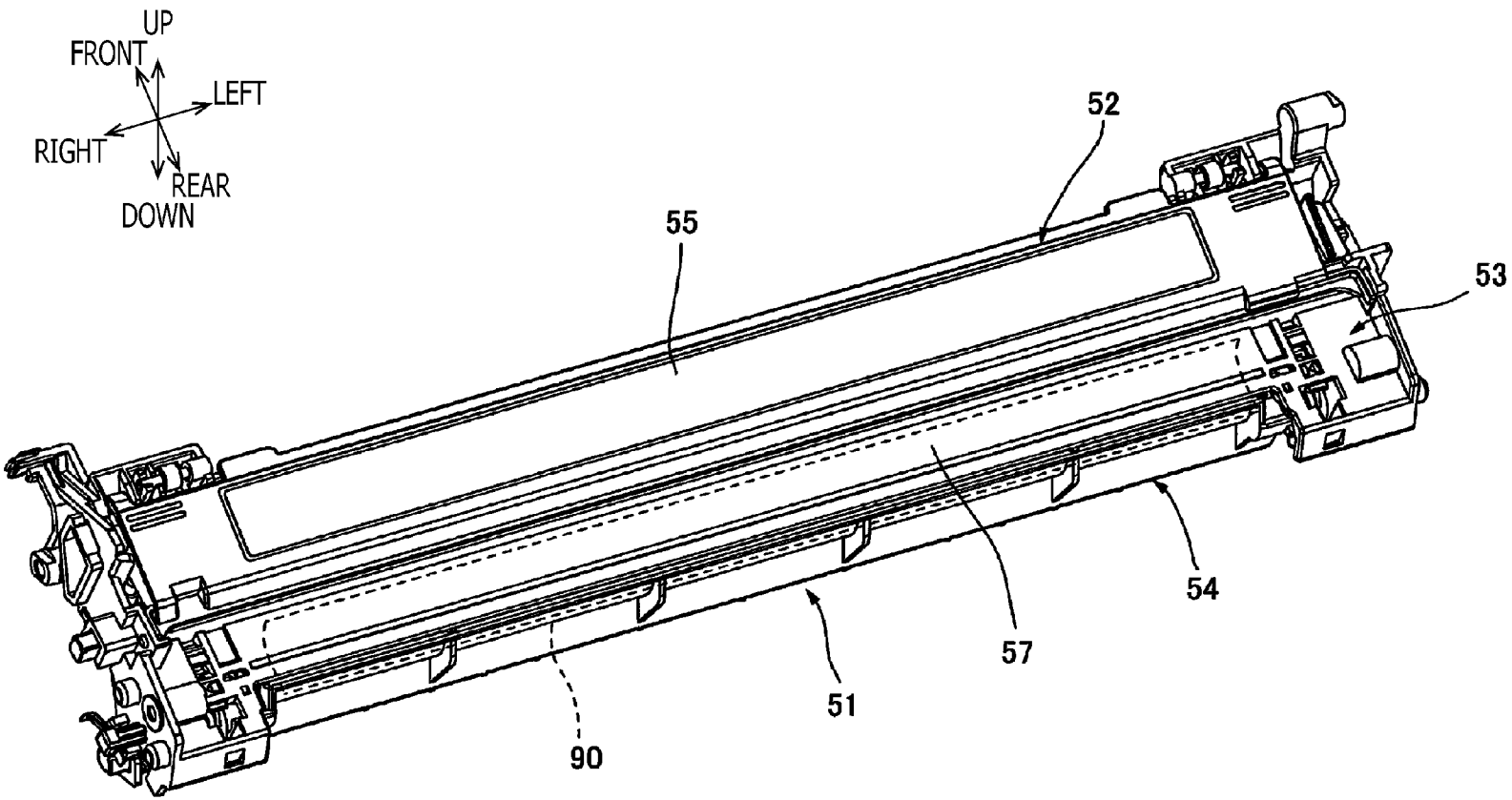
FIG. 5 is a perspective view showing a sub frame as viewed from an upper rear side in the first embodiment according to one or more aspects of the present invention.

As shown in FIGS. 5 and 6, each drum subunit 51 is disposed at an upper rear side of the corresponding photoconductive drum 17. Each drum subunit 51 includes a sub frame 52, the aforementioned scorotron charger 18, and a drum cleaning roller 29.

Each sub frame 52 includes a first frame 53, a second frame 54, and a cover member 55.

Each first frame 53 is disposed at an upper rear side of the corresponding photoconductive drum 17. Each first frame 53 includes a charge supporting wall 56, a first extended wall 57, and a second extended wall 58.

The charge supporting wall 56 is formed in a rectangular tube shape extending in the left-to-right direction. Further, the charge supporting wall 56 includes openings 59 (an upper opening 59 and a lower opening 59) formed in an upper wall and a lower wall of the charge supporting wall 56, respectively. Each opening 59 is formed in a rectangular shape extending in the left-to-right direction in a plane view (not shown). Further, the openings 59 are formed to penetrate the upper wall and the lower wall of the charge supporting wall 56, respectively.

The first extended wall 57 is formed substantially in such a plate shape as to extend toward a lower rear side continuously from a substantially middle portion of a rear wall of the charge supporting wall 56 in the vertical direction, and to extend over an entire length of the rear wall of the charge supporting wall 56 in the left-to-right direction.

The second extended wall 58 extends toward an upper front side continuously from a lower end portion of a front wall of the charge supporting wall 56, and thereafter is bent and extends toward an upper rear side. Further, the second extended wall 58 extends over an entire length of the front wall of the charge supporting wall 56 (although the feature is not shown in any drawings).

The second frame 54 is disposed behind the corresponding photoconductive drum 17, and below the first extended wall 57. The second frame 54 is formed substantially in an arc shape open toward an upper front side. Further, the second frame 54 extends in the left-to-right direction. The second frame 54 is disposed such that an upper end portion thereof is located below and adjacent to a rear end portion of the first extended wall 57. Thereby, a roller accommodation space 61 configured to accommodate the drum cleaning roller 29 is formed and defined (demarcated) by the first extended wall 57, the second frame 54, and a rear part of a circumferential surface of the photoconductive drum 17.

The cover member 55 is formed substantially in a rectangular plate shape extending in the left-to-right direction in a plane view. The cover member 55 is configured to cover the charge supporting wall 56 and the second extended wall 58 from above. Further, as shown in FIG. 6, a rear end portion of the cover member 55 engages with an upper end portion of the rear wall of the charge supporting wall 56. Moreover, a front end portion of the cover member 55 engages with an upper end portion of the second extended wall 58.

Thereby, an airflow path 60 configured to supply air to the scorotron charger 18 is formed and defined (demarcated) by the second extended wall 58, the charge supporting wall 56, and the cover member 55. The airflow path 60 is formed to penetrate the sub frame 52 in the left-to-right direction.

The scorotron charger 18 is fitted into the charge supporting wall 56. Thereby, a lower end portion of the scorotron charger 18 is exposed via the lower opening 59. The scorotron charger 18 is disposed apart from the corresponding photoconductive drum 17, at an upper rear side of the corresponding photoconductive drum 17.

The drum cleaning roller 29 is disposed in the roller accommodation space 61. A front end portion of the drum cleaning roller 29 is in contact with the corresponding photoconductive drum 17.

A left end portion and a right end portion of the first frame 53 of each sub frame 52 are supported by the two side walls 85, respectively. Thereby, the plurality of drum units 14 are supported by the drawer frame 16. In other words, the drawer frame 16 supports the plurality of scorotron chargers 18 via the plurality of sub frames 52.

Further, as shown in FIG. 8, when the drawer frame 16 is in the first position, each drum unit 14 is disposed lower than the duct main body 74, and the black drum unit 14K is disposed at a lower front side of the duct main body 74. In other words, the duct main body 74 is disposed higher than the four drum units 14 and behind the black drum unit 14K (downstream relative to the black drum unit 14K in a direction from the other side to the one side in the arrangement direction).

Further, each development cartridge 15 is disposed at an upper portion of the corresponding process unit 50 and at an upper front side of the corresponding drum unit 14. Thereby, the plurality of development cartridges 15 are arranged in parallel with each other at intervals in the front-to-rear direction, between upper portions of the two side walls 85.

As shown in FIG. 2, each development cartridge 15 is supported by the drawer frame 16, as a left end portion and a right end portion of the development cartridge 15 are supported by the two side walls 85 in an attachable and detachable manner, respectively.

Further, in the printer 1, when the drawer frame 16 is in the first position, as shown in FIG. 8, an airflow path 99 is formed and defined by the black drum unit 14K, the black development cartridge 15K, the rear beam 87 of the drawer frame 16, the two side walls 85, the duct-side regulating member 71, the drawer-side regulating member 90, and the duct portion 68. The airflow path 99 is configured to regulate a current of air containing ozone generated by the scorotron charger 18, by letting the air flow therethrough.

More specifically, the airflow path 99 is formed and defined (demarcated) by an upper face of the sub frame 52 of the black drum unit 14K (upper faces of the first extended wall 57 and the cover member 55), a rear face of the black development cartridge 15K, a front face of the rear beam 87, inner faces of the two side walls 85 in the left-to-right direction, a front face of the duct-side regulating member 71, an upper face of the drawer-side regulating member 90, and a front face of the duct main body 74. Namely, the airflow path 99 is configured to communicate with the internal space of the duct main body 74 via the filter openings 76.

4. Pulling Out the Drawer Frame from the Main Body Casing and Setting the Drawer Frame into the Main Body Casing Subsequently, referring to FIGS. 1, 2, and 6 to 8, explanations will be provided about operations of pulling out the drawer frame 16 from the main body casing 2 and setting the drawer frame 16 into the main body casing 2. It is noted that the main body casing 2 is not shown in FIGS. 6 to 8 for the sake of explanatory convenience.

(1) Movement of the Drawer Frame from the First Position to the Second Position (Pulling-Out Operation)

In order to move the drawer frame 16 from the first position to the second position, firstly, as shown in FIG. 2, a user turns (swings) the front cover 6 of the main body casing 2 from the closed position to the open position, and places the front cover 6 in the open position. Thereby, the opening 5 is opened.

At this time, as shown in FIG. 8, the pressing members 69 are moved toward an upper front side along the moving direction X by a known interlocking mechanism, in conjunction with the swing motion of the front cover 6 from the closed position to the open position. Thus, the contact between the pressing surfaces 81 and the drum-side reference shaft 89 is released. Thereby, the pressing state where the pressing members 69 press the drum-side reference shaft 89 is released, and a locked state where the drawer frame 16 is locked in (set in) the main body casing 2 is released.

Next, when the user pulls out the drawer frame 16 via the opening 5, as shown in FIG. 6, the drawer frame 16 moves toward an upper front side while guided by a guide portion (not shown) provided to the main body casing 2. At this time, the engagement between the notch portions 88 and the main-body-side reference shaft 67 is released.

Subsequently, when the user further pulls out the drawer frame 16 forward, the drawer frame 16 passes through the opening 5, and moves forward in a sliding manner.

Thereby, as shown in FIG. 2, the drawer frame 16 reaches the second position where all the process units 50 are placed outside the main body casing 2. At this time, each development cartridge 15 is exposed to an upper side.

According to the aforementioned procedure, the movement of the drawer frame 16 from the first position to the second position, that is, the operation of pulling out the drawer frame 16 from the main body casing 2 is completed.

When the user detaches a development cartridge 15 from the drawer frame 16, the user pulls the development cartridge 15 upward in the state where the drawer frame 16 is in the second position. Thereby, the development cartridge 15 is detached from the drawer frame 16. When the user attaches a development cartridge 15 to the drawer frame 16, the user inserts the development cartridge 15 into a corresponding portion of the drawer frame 16 from above in the state where the drawer frame 16 is in the second position. Thereby, the development cartridge 15 is attached to the drawer frame 16.

(2) Movement of the Drawer Frame from the Second Position to the First Position (Setting-in Operation)

An operation of moving the drawer frame 16 from the second position to the first position is performed in a procedure opposite to the aforementioned pulling-out operation.

Specifically, the user pushes the drawer frame 16 in the second position rearward. Thereby, the drawer frame 16 moves rearward in a sliding manner.

Subsequently, when the user further pushes the drawer frame 16 rearward, as shown in FIGS. 6 and 7, the drawer frame 16 moves toward a lower rear side while guided by the guide portion (not shown) provided to the main body casing 2. At this time, the notch portions 88 accept the main-body-side reference shaft 67 from a lower rear side of the notch portions 88, and engage with the main-body-side reference shaft 67. Thereby, a relative movement of the drawer frame 16 in the front-to-rear direction with respect to the main body casing 2 is regulated (and restricted). Namely, the main-body-side reference shaft 67 positions the drawer frame 16 relative to the main body casing 2.

Further, the rear beam 87 of the drawer frame 16 reaches a lower portion of the front wall of the duct main body 74, and an upper end portion of the rear beam 87 of the drawer frame 16 comes into contact with a lower end portion of the duct-side regulating member 71 from the front (from the other side to the one side along the arrangement direction). Thereby, the duct-side regulating member 71 is elastically deformed in such a curved shape as to lean rearward, so as to urge the rear beam 87 of the drawer frame 16 toward a lower front side.

According to the aforementioned procedure, the movement of the drawer frame 16 from the second position to the first position is completed, and the drawer frame 16 is set in the accommodation portion 40 of the main body casing 2.

Next, the user turns (swings) the front cover 6 from the open position to the closed position.

At this time, as shown in FIG. 8, by the known interlocking mechanism, the pressing members 69 are moved toward the lower rear side along the moving direction X in conjunction with the swing motion of the front cover 6.

Thereby, the pressing surfaces 81 of the pressing members 69 come into contact with the end portions of the drum-side reference shaft 89 in the left-to-right direction from an upper front side, so as to press the drum-side reference shaft 89 toward a lower rear side. Thus, the pressing members 69 press the drawer frame 16 toward a lower rear side via the drum-side reference shaft 89.

At this time, a pressing force F3 of the pressing members 69 can be decomposed into a pressing force component C5 to press the drawer frame 16 rearward and a pressing force component C6 to press the drawer frame 16 downward.

Therefore, when the pressing members 69 press the end portions of the drum-side reference shaft 89 in the left-to-right direction toward the lower rear side, the pressing force component C5 of the pressing members 69 presses the drawer frame 16 toward the main-body-side reference shaft 67, against the urging force component C1 of the duct-side regulating member 71 and the urging force component C3 of the drawer-side regulating member 90.

Further, the pressing force component C5 is set to be more than a summation of the urging force component C1 of the duct-side regulating member 71 and the urging force component C3 of the drawer-side regulating member 90.

Namely, the pressing members 69 press the drawer frame 16 toward the drum-side reference shaft 89, against the urging force component C1 and the urging force component C3, so as to regulate (and restrict) the relative movement of the drawer frame 16 with respect to the main body casing 2.

5. Exhaust Operation of Printer

In the above image forming operation, each scorotron charger 18 is supplied with air via the airflow path 60 of the corresponding sub frame 52.

Specifically, the air, after passing through the airflow path 60, is supplied to the scorotron charger 18 via the upper opening 59, and then flows toward the photoconductive drum 17, and is discharged via the lower opening 59.

The air discharged from the scorotron charger 18 in the aforementioned manner contains ozone generated due to discharge by scorotron charger 18.

At this time, air inside the duct main body 74 is discharged by rotation of the fan 72, out of the main body casing 2 via the fan opening 77 and one or more openings (not shown). Thus, air inside the main body casing 2 is introduced into the duct main body 74 via the filter openings 76 and the ozone filters 73.

Thereby, air inside the airflow path 99 is introduced into the duct main body 74, and the air flows in the airflow path 99 to generate an air current "a" (see FIG. 8) toward the filter openings 76.

In response to generation of the air current "a" in the airflow path 99, the air containing ozone, discharged from the scorotron charger 18 of the black process unit 50K, flows into the airflow path 99, e.g., via a gap between the black development cartridge 15K and the black drum unit 14K. Then, the air containing ozone that has flowed into the airflow path 99 joins the air current "a," and flows toward the filter openings 76 (see FIG. 9).

At this time, the drawer-side regulating member 90 regulates and restricts the air current "a" from entering between the black drum unit 14K and the rear beam 87. In addition, the duct-side regulating member 71 regulates and restricts the air current "a" from entering between the rear beam 87 and the duct main body 74.

When the air current "a" passes through the ozone filters 73, the ozone filters 73 capture volatile organic compound (VOC) contained in the air carried by the air current "a," and decompose and remove the ozone.

Figure 9:
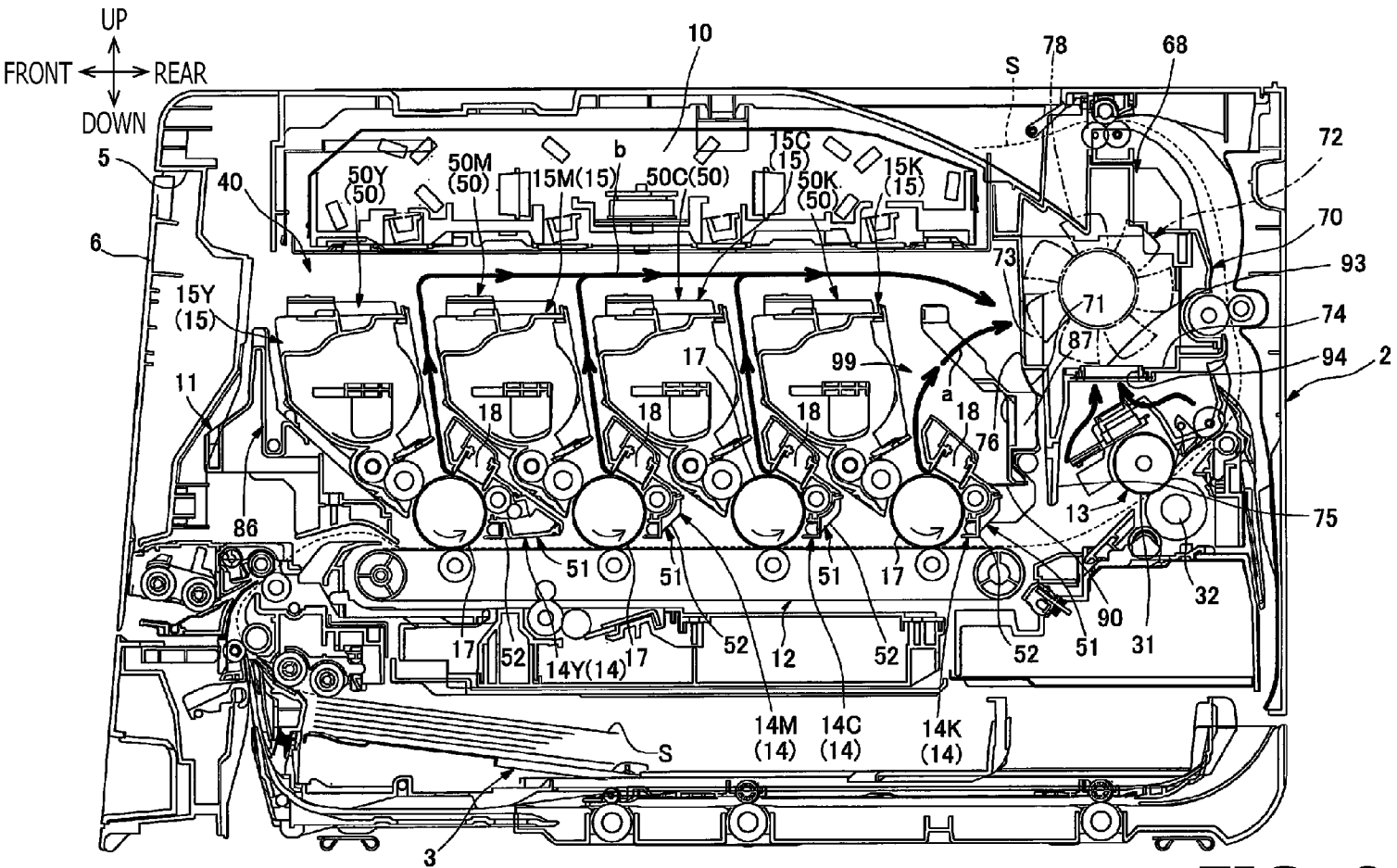
FIG. 9 illustrates an exhaust operation by the printer in the first embodiment according to one or more aspects of the present invention.

Further, as shown in FIG. 9, when the fan 72 rotates, air in a space between the drawer unit 11 and the scanning unit 10 (i.e., air around an upper end portion of the accommodation portion 40) is introduced into the duct main body 74 via the filter openings 76 and the ozone filters 73. Then, in the space between the drawer unit 11 and the scanning unit 10, the air flows rearward from the front, so as to generate an air current "b" toward the filter openings 76.

In response to generation of the air current "b," air containing ozone that has been discharged from the scorotron charger 18 of each of the yellow process unit 50Y, the magenta process unit 50M, and the cyan process unit 50C flows upward from a gap between the development cartridge 15 and the drum unit 14. Thereafter, the air passes upward through a gap between adjacent development cartridges 15. Thereby, the air containing ozone that has been discharged from the scorotron charger 18 of each of the yellow process unit 50Y, the magenta process unit 50M, and the cyan process unit 50C reaches the space between the drawer unit 11 and the scanning unit 10, joins the air current "b," and flows toward the filter openings 76. Then, in the same manner as described above, when the air current "b" passes through the ozone filters 73, the ozone filters 73 captures VOC, and decomposes and removes ozone.

Further, when the fan 72 rotates, air around the fuser unit 13 is introduced into the duct main body 74 via the fuser inlet port 94 and the toner filter 93. Thereby, an air current toward the fuser inlet port 94 is generated around the fuser unit 13, so as to radiate heat generated from the fuser unit 13. Thereby, the fuser unit 13 is cooled. Then, when the air current for radiating the heat generated from the fuser unit 13 passes through the toner filter 93, the toner filter 93 captures contaminants (such as toner and paper powder) contained in the air carried by the air current.

Subsequently, when rotating, the fan 72 sucks the air introduced into the duct main body 74, and lets the air flow rightward from the left in the duct main body 74. After that, the fan 72 discharges the air out of the duct main body 74 via the fan opening 77 and one or more openings (not shown). Namely, the duct main body 74 is configured to discharge the air in the main body casing 2 outside.

6. Operations and Advantageous Effects (1) In the printer 1, as shown in FIG. 8, the drawer-side regulating member 90 configured to regulate the air current is disposed between the black drum unit 14K and the rear beam 87 of the drawer frame 16. Therefore, around the black drum unit 14K, it is possible to regulate and restrict the air containing ozone generated by the scorotron chargers 18 from entering an undesired space, by the drawer-side regulating member 90.

Consequently, it is possible to secure a smooth current of the air containing ozone, around the black drum unit 14K.

Further, the drawer-side regulating member 90 urges the black drum unit 14K toward the lower front side. Therefore, even though the black drum unit 14K begins to rattle, it is possible to cause the drawer-side regulating member 90 to follow the rattling of the black drum unit 14K. Consequently, it is possible to prevent generation of a gap between the black drum unit 14K and the drawer-side regulating member 90, and certainly regulate the air current by the drawer-side regulating member 90.

Therefore, according to the printer 1, it is possible to secure a smooth air current around the black drum unit 14K. Further, even though the black drum unit 14K begins to rattle, it is possible to certainly regulate the air current by the drawer-side regulating member 90.

(2) Further, as shown in FIG. 8, the rear end portion of the drawer-side regulating member 90 is supported by the rear beam 87 of the drawer frame 16, and the front end portion of the drawer-side regulating member 90 is in contact with the black drum unit 14K.

Therefore, even with such a simple configuration, it is possible to certainly dispose the drawer-side regulating member 90 between the black drum unit 14K and the rear beam 87 of the drawer frame 16.

(3) Further, as shown in FIG. 8, the drawer-side regulating member 90 is a flexible member configured to be elastically deformed.

Therefore, as the drawer-side regulating member 90, in an elastically deformed state, is brought into contact with the black drum unit 14K, the drawer-side regulating member 90 urges the black drum unit 14K.

As a result, it is possible to achieve a smaller number of components than when a separate member is employed to urge the drawer-side regulating member 90 toward the black drum unit 14K.

(4) Further, as shown in FIG. 1, the printer 1 includes the fuser unit 13. In addition, the printer 1 includes the plurality of drum units 14 corresponding to the plurality of colors, i.e., yellow, magenta, cyan, and black, respectively.

Therefore, it is possible to form a full-color image on a sheet S by the plurality of drum units 14, and to certainly fix the image onto the sheet S by the fuser unit 13.

Meanwhile, the fuser unit 13 generates heat when fixing the image on the sheet S. Hence, the printer 1 is configured to, by rotating the fan 72, generate an air current around the fuser unit 13, and radiate the heat generated from the fuser unit 13. Therefore, the air containing ozone might join the air current for radiating the heat from the fuser unit 13, and might enter an undesired space.

However, in the printer 1, the black drum unit 14K is disposed closest to the fuser unit 13 among the plurality of drum units 14, and the drawer-side regulating member 90 is disposed between the black drum unit 14K and the rear beam 87 of the drawer frame 16.

Therefore, even though the air current is generated to radiate the heat from the fuser unit 13, it is possible to certainly prevent the air containing ozone from joining the air current for radiating the heat from the fuser unit 13, i.e., from entering an undesired space, by drawer-side regulating member 90.

(5) Further, as shown in FIG. 8, the black drum unit 14K, the rear beam 87 of the drawer frame 16, and the drawer-side regulating member 90 form a part of the airflow path 99.

Therefore, it is possible to certainly introduce the air containing ozone generated by the scorotron chargers 18 into the airflow path 99.

Consequently, it is possible to certainly secure a smooth current of the air containing ozone, around the black drum unit 14K.

(6) Further, as shown in FIG. 1, the duct main body 74 of the duct portion 68 is disposed above the plurality of drum units 14 and behind the black drum unit 14K.

Therefore, it is possible to discharge the air containing ozone generated by each scorotron charger 18, out of the main body casing 2, all together via the duct portion 68, by letting the air flow upward and then flow rearward. Consequently, it is possible to prevent staying of ozone within the main body casing 2.

7. Second Embodiment

Subsequently, referring to FIGS. 10 and 11, an explanation will be provided about a printer 110 in a second embodiment according to aspects of the present invention. It is noted that, in the second embodiment, the same elements as exemplified in the first embodiment will be provided with the same reference characters, and explanations thereof will be omitted.

In the aforementioned first embodiment, as shown in FIG. 2, each process unit 50 is a separation-type process unit that includes the drum unit 14 supported by the drawer frame 16, and the development cartridge 15 detachably attached to the drawer frame 16.

Figure 11:
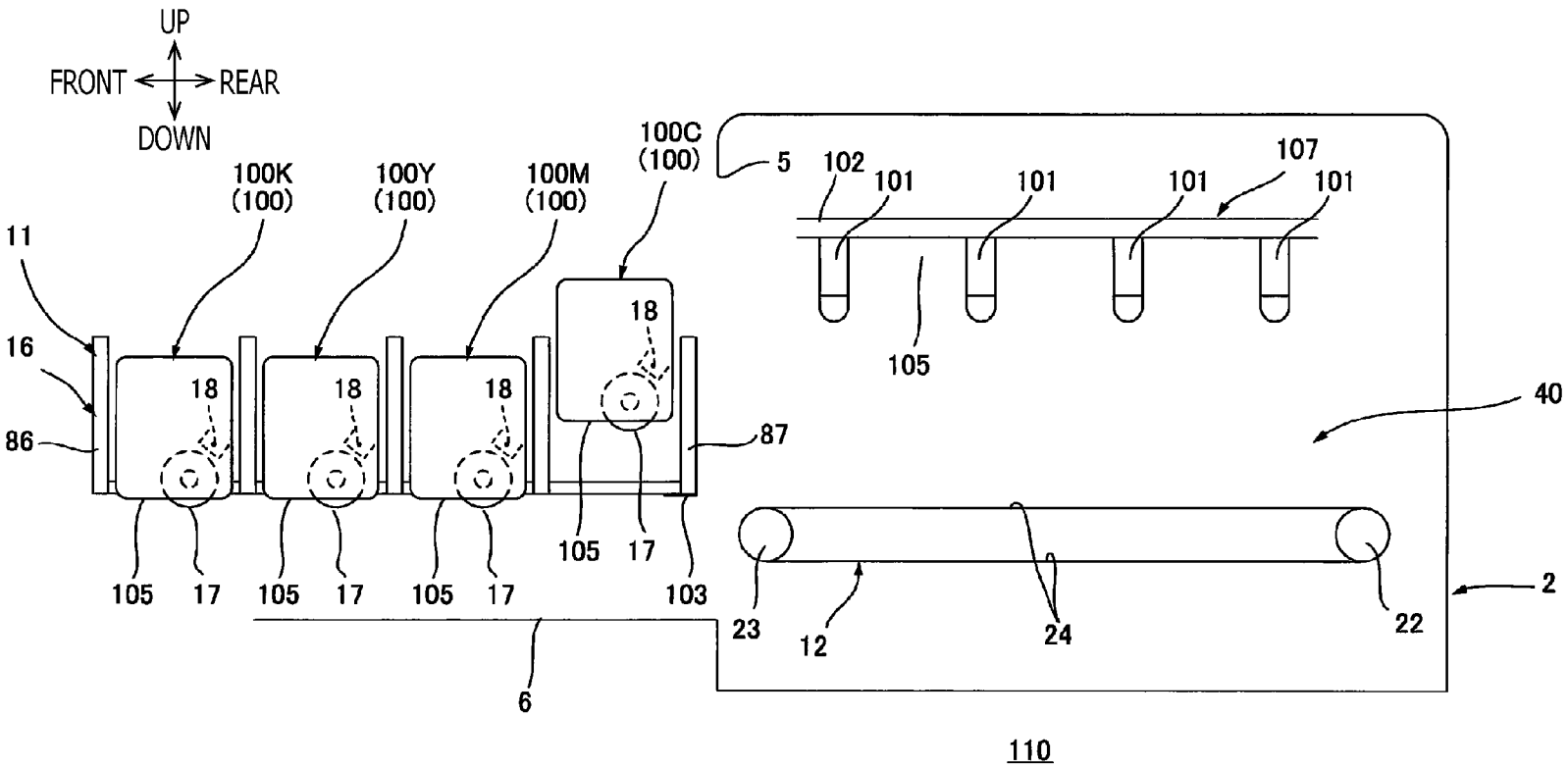
FIG. 11 shows a state where the drawer frame is in a second position in the second embodiment according to one or more aspects of the present invention.

On the contrary, in the second embodiment, as shown in FIG. 11, process cartridges 100, each integrated as a single body, are supported by the drawer frame 16 in an attachable and detachable manner.

The process cartridges 100 are four process cartridges provided corresponding to the four colors, i.e., black, yellow, magenta, and cyan, respectively.

The four process cartridges 100 are arranged in parallel with each other at intervals in the front-to-rear direction, in the drawer frame 16. More specifically, the four process cartridges 100 are arranged serially in order of a black process cartridge 100K, a yellow process cartridge 100Y, a magenta process cartridge 100M, and a cyan process cartridge 100C from front to back. Namely, among the plurality of process cartridges 100, the cyan process cartridge 100C is the rearmost process cartridge (disposed at the one-side end portion in the arrangement direction).

Further, each process cartridge 100 includes a unit frame 105, a photoconductive drum 17, a scorotron charger 18, a drum cleaning roller 29, a development roller 19, a supply roller 20, and a layer thickness regulating blade 21. It is noted that any of the drum cleaning roller 29, the development roller 19, the supply roller 20, and the layer thickness regulating blade 21 is not shown in FIG. 10 or 11, and explanation thereof will be omitted, for the sake of explanatory convenience.

The unit frame 105 is formed substantially in a box shape of which a lower end portion is open. Further, the unit frame 105 supports the photoconductive drum 17 and the scorotron charger 18 and stores toner, in an internal space of the unit frame 105.

The photoconductive drum 17 is disposed at a lower end portion in the unit frame 105, such that a lower end portion of the photoconductive drum 17 is exposed out of the unit frame 105. The scorotron charger 18 is disposed apart from the photoconductive drum 17, at an upper rear side of the photoconductive drum 17.

Figure 10:
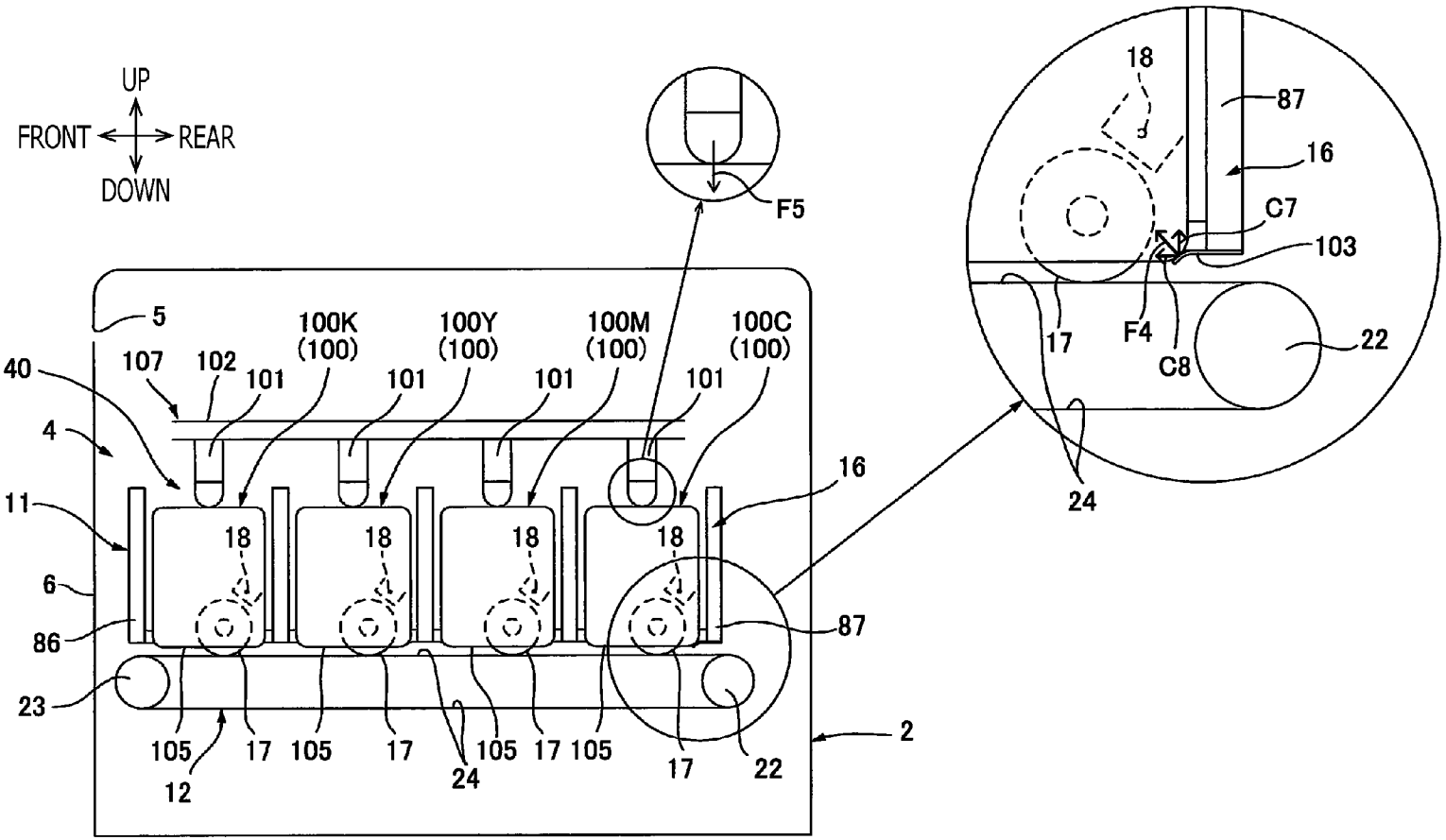
FIG. 10 is a cross-sectional side view showing a printer when a drawer frame is in a first position in a second embodiment according to one or more aspects of the present invention.

Further, as shown in FIG. 10, the drawer frame 16 supports a regulating member 103.

The regulating member 103 is made of flexible material, more specifically, a resin film such as polyethylene terephthalate (PET). Therefore, the regulating member 103 is configured to be elastically deformed. Further, the regulating member 103 is formed substantially in a rectangular shape extending in the left-to-right direction in a plane view, and extends in the front-to-rear direction in a side view.

The regulating member 103 is supported by the drawer frame 16, as a rear end portion of the regulating member 103 is fixed to a lower end portion of the rear beam 87.

Further, when the cyan process cartridge 100C is attached to the drawer frame 16, a front end portion of the regulating member 103 comes into contact with a lower rear end portion of the unit frame 105 of the cyan process cartridge 100C from a lower rear side, and contacts the lower rear end portion of the unit frame 105 of the cyan process cartridge 100C along the left-to-right direction. Namely, the regulating member 103 is disposed between the cyan process cartridge 100C and the rear beam 87.

Thereby, the front end portion of the regulating member 103 is elastically deformed along the lower rear end portion of the unit frame 105 of the cyan process cartridge 100C, in such a curved shape as to lean downward. Therefore, the regulating member 103 urges the cyan process cartridge 100C toward an upper front side.

An urging force F4 of the regulating member 103 can be decomposed into an urging force component C7 to urge the cyan process cartridge 100C upward and an urging force component C8 to urge the cyan process cartridge 100C forward.

Further, the main body casing 2 includes a pressing unit 107. The pressing unit 107 is configured to concurrently press the plurality of process cartridges 100 supported by the drawer frame 16.

The pressing unit 107 is disposed above the drawer frame 16 set in the first position, inside the main body casing 2. The pressing unit 107 includes a plurality of pressing portions 101 and a supporting portion 102 configured to support the plurality of pressing portions 101.

The plurality of pressing portions 101 are provided corresponding to the plurality of process cartridges 100, respectively. The plurality of pressing portions 101 are arranged in parallel with each other at intervals in the front-to-rear direction. Each pressing portion 101 is disposed above the corresponding process cartridge 100. Further, each pressing portion 101 is formed substantially in a rod shape extending in the vertical direction. A lower end portion of each pressing portion 101 is chamfered substantially in a semicircle shape in a side view.

The supporting portion 102 is formed in a plate shape extending in the front-to-rear direction, and is configured to support all the plurality of pressing portions 101 together.

The pressing unit 107 is configured to move in conjunction with the swing motion of the front cover 6 by a known interlocking mechanism. Specifically, when the front cover 6 is in the open position, the pressing unit 107 is retracted upward. Meanwhile, when the front cover 6 is in the closed position, the pressing unit 107 is moved downward.

Further, when the front cover 6 is in the closed position, the pressing unit 107 is moved downward, and each pressing portion 101 presses the unit frame 105 of the corresponding process cartridge 100 downward.

Next, explanations will be provided about an operation of pulling out the drawer frame 16 from the main body casing 2 and an operation of setting the drawer frame 16 into the main body casing 2.

In order to move the drawer frame 16 from the first position to the second position, firstly, as shown in FIG. 11, the user places the front cover 6 of the main body casing 2 in the open position.

At this time, the pressing unit 107 is retracted upward by a known interlocking mechanism. Next, when the user pulls the drawer frame 16 forward via the opening 5, the drawer frame 16 is moved forward.

Thereby, the drawer frame 16 reaches the second position where all the process units 50 are out of the main body casing 2.

Thus, the movement of the drawer frame 16 from the first position to the second position, i.e., the operation of pulling out the drawer frame 16 from the main body casing 2 is completed.

When the user detaches a process cartridge 100 from the drawer frame 16, the user pulls the process cartridge 100 upward in the state where the drawer frame 16 is in the second position. Thereby, the process cartridge 100 is detached from the drawer frame 16. When the user attaches a process cartridge 100 to the drawer frame 16, the user inserts the process cartridge 100 into a corresponding portion of the drawer frame 16 from above in the state where the drawer frame 16 is in the second position. Thereby, the process cartridge 100 is attached to the drawer frame 16.

When the cyan process cartridge 100C is attached to the drawer frame 16, the lower rear end portion of the unit frame 105 of the cyan process cartridge 100C comes into contact with the front end portion of the regulating member 103 from above. Thereby, as described above, the front end portion of the regulating member 103 is deformed in such a curved shape as to lean downward.

An operation of moving the drawer frame 16 from the second position to the first position is performed in a procedure opposite to the aforementioned pulling-out operation.

Specifically, the user pushes the drawer frame 16 in the second position rearward. Thereby, the drawer frame 16 moves rearward in a sliding manner. Thus, the drawer frame 16 moves from the second position to the first position, and is set in the accommodation portion 40 of the main body casing 2.

Next, the user turns (swings) the front cover 6 from the open position to the closed position.

At this time, as shown in FIG. 10, by the known interlocking mechanism, the pressing unit 107 is moved downward in conjunction with the swing motion of the front cover 6 from the open position to the closed position.

Thereby, each pressing portion 101 of the pressing unit 107 comes into contact with the upper end portion of the unit frame 105 of the corresponding process cartridge 100 from above, so as to press the corresponding process cartridge 100 downward. Namely, the pressing unit 107 presses the cyan process cartridge 100C downward.

At this time, a pressing force F5 of the pressing portion 101 is set to be more than the urging force component C7 of the regulating member 103.

In other words, the pressing unit 107 presses the cyan process cartridge 100C downward against the urging force component C7, so as to regulate (and restrict) a relative movement of the cyan process cartridge 100C with respect to the drawer frame 16.

Therefore, it is possible to prevent deterioration in the accuracy of the relative position of the cyan process cartridge 100C with respect to the drawer frame 16.

Consequently, it is possible to secure a smooth current of the air containing ozone around the cyan process cartridge 100C. Furthermore, even though the cyan process cartridge 100C begins to rattle, the regulating member 103 is allowed to certainly regulate the air current. Moreover, it is possible to prevent deterioration in the accuracy of the relative position of the cyan process cartridge 100C with respect to the drawer frame 16.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

8. Modifications

In the aforementioned first embodiment, as shown in FIG. 8, the upper end portion of the duct-side regulating member 71 is fixed to the front wall of the duct main body 74. Further, the lower end portion of the duct-side regulating member 71 comes into contact with the upper end portion of the rear beam 87 of the drawer frame 16 in the first position from the upper rear side.

Nonetheless, as indicated by a virtual line in FIG. 8, the duct-side regulating member 71 may be configured (disposed) such that the lower end portion thereof is fixed to the upper end portion of the rear beam 87, and that the upper end portion of the duct-side regulating member 71 comes into contact with the lower end portion of the front wall of the duct main body 74 from a lower front side, when the drawer frame 16 is in the first position.

In this case, the duct-side regulating member 71 may be elastically deformed and bent toward the one side from the other side in the arrangement direction, in such a curved shape as to lean forward.

In this case as well, the duct-side regulating member 71 is disposed between the rear beam 87 and the duct main body 74. Namely, with a simple configuration, it is possible to more certainly dispose the duct-side regulating member 71 between the rear beam 87 and the duct main body 74.

Further, in the aforementioned first embodiment, the duct-side regulating member 71 is disposed between the rear beam 87 and the duct main body 74. Nonetheless, the duct-side regulating member 71 may be disposed between the front beam 86 and a front end portion of the main body casing 2 (e.g., the front cover 6). In this case, the front side may correspond to the one side in the arrangement direction, and the rear side may correspond to the other side in the arrangement direction. Additionally, the front cover 6 may be exemplified as an inner wall.

In the aforementioned first embodiment, as shown in FIG. 8, the drawer-side regulating member 90 is disposed between the black process unit 50K and the rear beam 87. Further, in the aforementioned second embodiment, as shown in FIG. 10, the regulating member 103 is disposed between the cyan process cartridge 100C and the rear beam 87.

Nonetheless, for instance, the drawer-side regulating member 90 may be disposed between the yellow process unit 50Y and the front beam 86. Further, the regulating member 103 may be disposed between the black process cartridge 100K and the front beam 86. In these cases, the front side may correspond to the one side in the arrangement direction, and the rear side may correspond to the other side in the arrangement direction.

Further, in the aforementioned embodiments, the duct-side regulating member 71, the drawer-side regulating member 90, and the regulating member 103 are made of flexible resin films. Nonetheless, the duct-side regulating member 71, the drawer-side regulating member 90, and the regulating member 103 may be made of elastic foam bodies such as sponges. Alternatively, the duct-side regulating member 71, the drawer-side regulating member 90, and the regulating member 103 may be shutters having urging members such as springs.

Further, in the aforementioned embodiments, the printer 1 and the printer 110 are provided with the scorotron chargers 18. Nonetheless, instead of the scorotron chargers 18, the printer 1 and the printer 110 may be provided with known chargers such as charging rollers.

What is claimed is:

1. An image forming apparatus comprising:

an apparatus main body;

a plurality of image forming units arranged in parallel with each other at intervals in a first direction toward a first side from a second side of the image forming apparatus, each image forming unit comprising:

a photoconductive drum; and a charger configured to charge the photoconductive drum;

a frame body configured to support the plurality of image forming units, and movable along the first direction relative to the apparatus main body; and a regulating member being a flexible member, the regulating member being disposed between a first-side image forming unit and a first-side end portion of the frame body in the first direction, the first-side image forming unit being closest to the first side in the first direction among the plurality of image forming units, the regulating member having a first-side end portion and a second-side end portion in the first direction, the first-side end portion of the regulating member being fixed to a first one of the first-side image forming unit and the first-side end portion of the frame body, the second-side end portion of the regulating member being configured to contact a second one of the first-side image forming unit and the first-side end portion of the frame body, the regulating member being configured to urge the first-side image forming unit.

2. The image forming apparatus according to claim 1, wherein the regulating member is configured such that the first-side end portion of the regulating member in the first direction is supported by the first-side end portion of the frame body in the first direction, and wherein the regulating member is further configured such that the second-side end portion of the regulating member in the first direction contacts the first-side image forming unit.

3. The image forming apparatus according to claim 1, further comprising a fuser unit configured to fix an image on a sheet, wherein the plurality of image forming units are provided corresponding to a plurality of colors, respectively, and wherein the first-side image forming unit is closest to the fuser unit among the plurality of image forming units.

4. The image forming apparatus according to claim 1, further comprising an airflow guide configured to regulate a current of air containing ozone generated by the plurality of chargers, the airflow guide being defined by the first-side image forming unit, the first-side end portion of the frame body in the first direction, and the regulating member.

5. The image forming apparatus according to claim 1, wherein the apparatus main body is configured to accommodate the frame body, the apparatus main body comprising an exhaust port disposed higher than the plurality of image forming units and downstream relative to the first-side image forming unit in the first direction from the second side to the first side, the exhaust port configured to discharge air inside the apparatus main body to an outside of the apparatus main body.

6. An image forming apparatus comprising:

an apparatus main body:

a plurality of process cartridges arranged in parallel with each other at intervals in a predetermined direction toward a first side from a second side of the image forming apparatus, each process cartridge comprising:

a photoconductive drum; and a charger configured to charge the photoconductive drum;

a frame body configured to support the plurality of process cartridges in an attachable and detachable manner, and movable along the predetermined direction relative to the apparatus main body;

a regulating member being a flexible member, the regulating member being disposed between a first-side process cartridge and a first-side end portion of the frame body in the predetermined direction, the first-side process cartridge being closest to the first side in the predetermined direction among the plurality of processed cartridges, the regulating member having a first-side end portion and a second-side end portion in the predetermined direction, the first-side end portion of the regulating member being fixed to a first one of the first-side process cartridge and the first-side end portion of the frame body, the second-side end portion of the regulating member being configured to contact a second one of the first-side process cartridge and the first-side end portion of the frame body, the regulating member being configured to apply an urging force to the first-side process cartridge; and a pressing member configured to press the first-side process cartridge supported by the frame body and to regulate a relative movement of the first-side process cartridge with respect to the frame body against the urging force of the regulating member.

7. An image forming apparatus comprising:

an apparatus main body:

a plurality of image forming units arranged in parallel with each other at intervals in a predetermined direction toward a first side from a second side of the image forming apparatus, each image forming unit comprising:

a photoconductive drum; and a charger configured to charge the photoconductive drum;

a frame body configured to support the plurality of image forming units and movable along the predetermined direction relative to the apparatus main body; and a regulating member being a flexible member, the regulating member being disposed between a first-side image forming unit and a first-side end portion of the frame body in the predetermined direction, so as to define at least a part of an airflow path formed to regulate an air current, the first-side image forming unit being closest to the first side in the predetermined direction among the plurality of image forming units, the regulating member having a first-side end portion and a second-side end portion in the predetermined direction, the first-side end portion of the regulating member being fixed to a first one of the first-side image forming unit and the first-side end portion of the frame body, the second-side end portion of the regulating member being configured to contact a second one of the first-side image forming unit and the first-side end portion of the frame body, the regulating member being configured to urge the first-side image forming unit.

* * * * *